US012807290B2

(12) United States Patent
Jan et al.

(10) Patent No.: US 12,807,290 B2
(45) Date of Patent: Nov. 24, 2026

(54) TETHERED-WING TRACTION SYSTEM COMPRISING A DEVICE FOR GRIPPING FOLDING LINES

(71) Applicant: AIRSEAS, Nantes (FR)

(72) Inventors: Stephane Jan, Montgiscard (FR); Nicolas Fantin, Launaguet (FR)

(73) Assignee: KAWASAKI KISEN KAISHA LTD, Tokyo (JP)

( * ) Notice: Subject to any disclaimer, the term of this patent is extended or adjusted under 35 U.S.C. 154(b) by 541 days.

(21) Appl. No.: 18/549,909

(22) PCT Filed: Mar. 16, 2022

(86) PCT No.: PCT/EP2022/056883

§ 371 (c)(1),
(2) Date: Sep. 9, 2023

(87) PCT Pub. No.: WO2022/194963

PCT Pub. Date: Sep. 22, 2022

(65) Prior Publication Data

US 2024/0166321 A1 May 23, 2024

(30) Foreign Application Priority Data

Mar. 19, 2021 (FR) ..... FR2102790

(51) Int. Cl.
*B63H 9/072* (2020.01)
*B63B 35/00* (2020.01)

(52) U.S. Cl.
CPC ..... *B63H 9/072* (2020.02); *B63B 2035/009* (2013.01)

(58) Field of Classification Search
CPC .. B63H 9/072; B63H 9/069; B63B 2035/009; Y02T 70/5236
See application file for complete search history.

(56) References Cited

U.S. PATENT DOCUMENTS

| | | | | |
|---|---|---|---|---|
| 7,287,481 | B1 | 10/2007 | Wrage | |
| 10,569,871 | B2 * | 2/2020 | Chafe | B64F 3/00 |
| 11,225,311 | B2 * | 1/2022 | Arrouy | B63H 9/1021 |
| 2004/0099196 | A1 * | 5/2004 | Grenier | B63H 9/069 114/102.16 |
| 2007/0157868 | A1 * | 7/2007 | Wrage | B63H 9/071 114/365 |
| 2011/0041747 | A1 * | 2/2011 | Reusch | B63H 9/069 114/39.29 |

FOREIGN PATENT DOCUMENTS

| | | |
|---|---|---|
| FR | 3082184 | 12/2019 |

* cited by examiner

*Primary Examiner* — Anthony D Wiest
(74) *Attorney, Agent, or Firm* — Defillo & Associate, Inc; Evelyn A. Defillo

(57) ABSTRACT

Tethered-wing traction system including: a traction wing; a base platform; a mooring mast; a plurality of folding lines; a folding carriage adapted to slide along the mooring mast; an input device (22) which is attached to the leading edge of the traction wing and which has a hooking arm (25) provided with a hooking stem (27A, 27B, 27C), one of the folding lines projecting into the extension of the hooking stem (27A, 27B, 27C); the folding carriage having a gripping hook which is movable between a retracted position and a gripping position in which the gripping hook surrounds the hooking stem (27A, 27B, 27C).

21 Claims, 13 Drawing Sheets

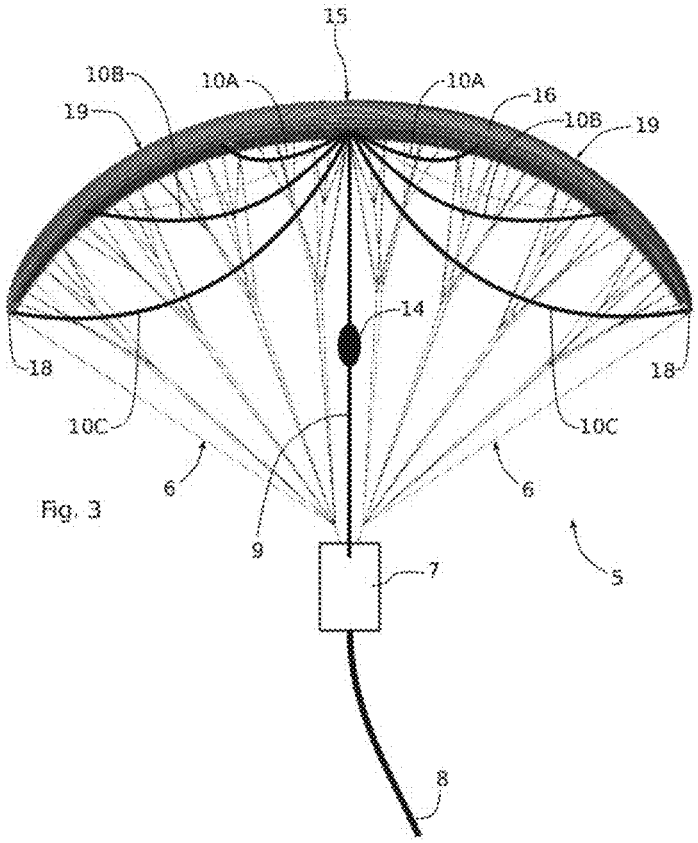
Fig. 3
Fig. 4
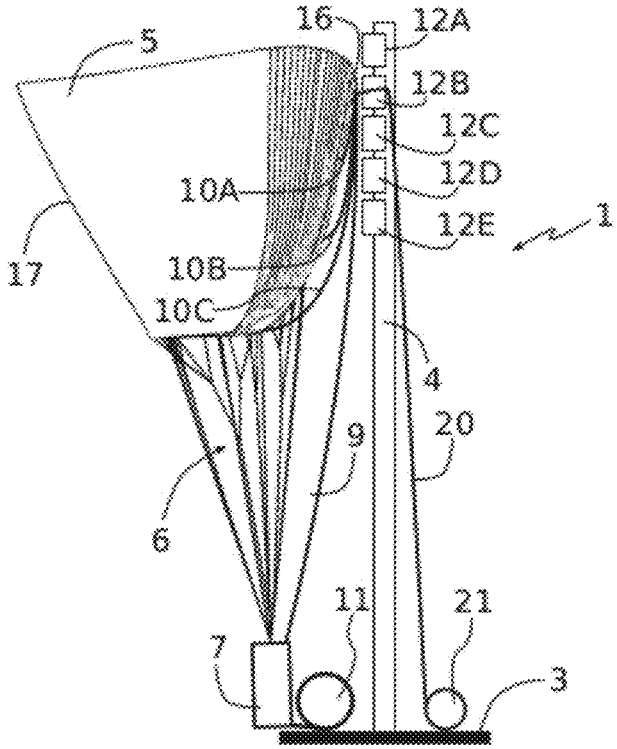

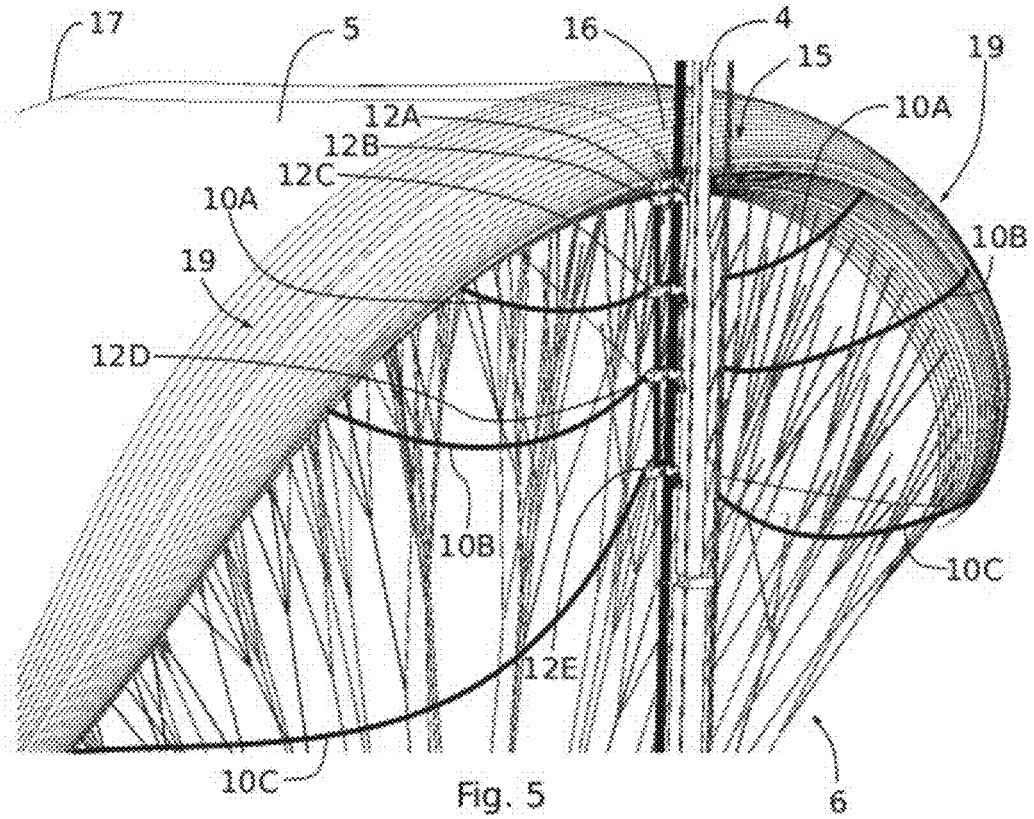
Fig. 5
Fig. 6
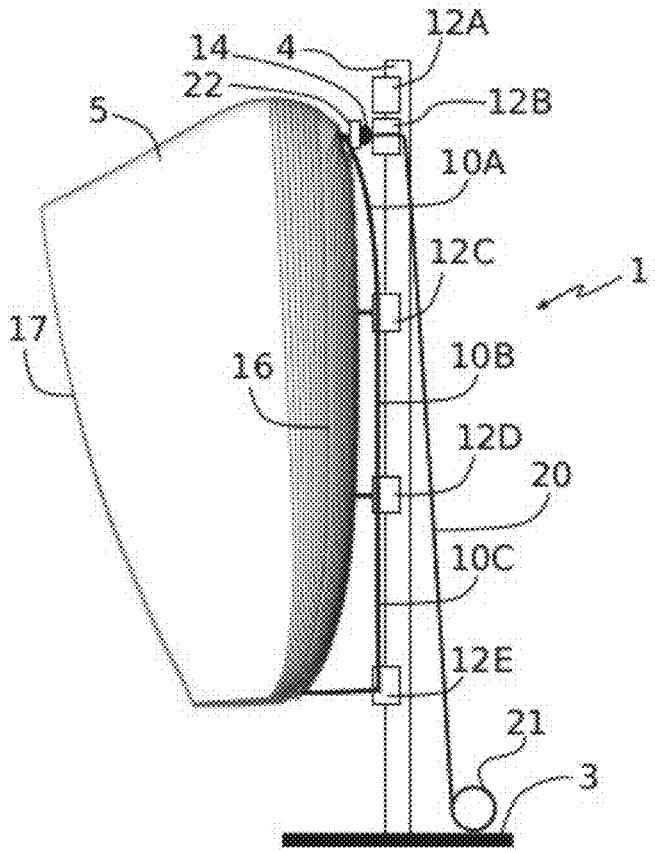

Fig. 7
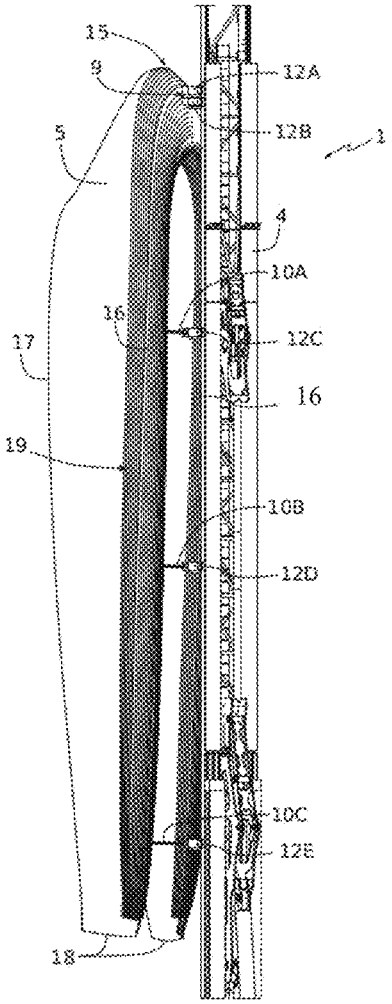
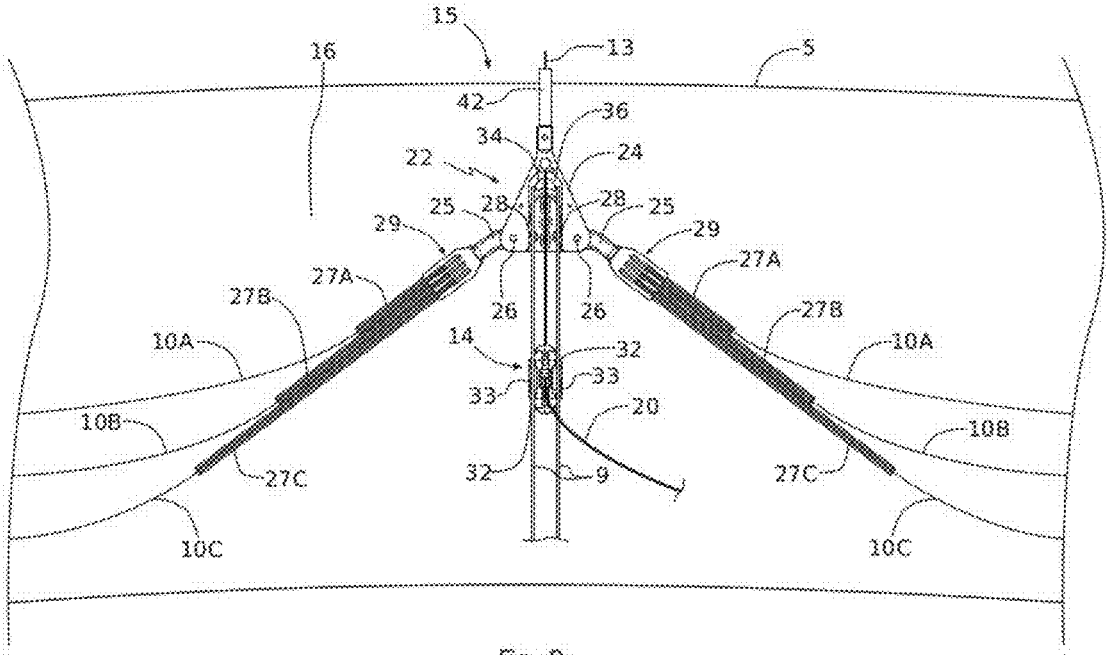
Fig. 8

TETHERED-WING TRACTION SYSTEM COMPRISING A DEVICE FOR GRIPPING FOLDING LINES

CROSS REFERENCE TO RELATED APPLICATION

This application is a national stage entry of PCT/EP2022/056883 filed Mar. 16, 2022, under the International Convention and claiming priority over French Patent Application No. FR2102790 filed Mar. 19, 2021.

TECHNICAL FIELD

The invention relates to the field of tethered-wing traction systems which are designed to deploy and fold a traction wing in relation to a base platform, this traction wing being designed to generate a traction force under the effect of the wind.

Such traction systems make it possible to deploy a flying traction wing used for the propulsion of a vehicle, notably a ship (as main propulsion or by way of support), for the generation of electricity, or for any application benefiting from such a traction force.

PRIOR ART

The French patent application FR3082184 describes a tethered-wing traction system and a method for deploying and folding the traction wing. The traction wing has folding lines secured to its leading edge and the system has means for pulling on at least three folding lines in order to bring the leading edge against the mast at least at two different heights along this mast.

This traction system benefits from a more efficient and more reliable deployment and folding method.

SUMMARY OF THE INVENTION

An aim of the invention is to improve the tethered-wing traction systems of the prior art.

To that end, the invention concerns a tethered-wing traction system having:

- a traction wing designed to generate a traction force under the effect of the wind, this traction wing having a leading edge and a trailing edge;
- a base platform to which the traction wing is connected via a traction line, the traction wing being designed to be deployed and folded in relation to this base platform;
- a mooring mast for the traction wing, disposed on the base platform;
- multiple folding lines each having an end fixed to the leading edge of the traction wing, the ends being spaced apart from one another along this leading edge.

This tethered-wing traction system also has:

- a folding carriage designed to slide along the mooring mast;
- a capturing device which is attached to the leading edge of the traction wing and has a fastening arm provided with a fastening rod, one of the folding lines projecting in the continuation of the fastening rod; and the folding carriage has a capturing hook which is movable between a retracted position and a capturing position, in which the capturing hook surrounds the fastening rod.

According to another object, the invention concerns a process for deploying or folding the traction wing of such a traction system, this process comprising a step of immobilizing the capturing device in relation to the folding carriage in a position in which the fastening rod faces the capturing hook.

Throughout the text, the terms "one" or "a" in the formulations "one/a carriage", "one/a fastening arm", "one/a rod" and "one/a hook" are to be understood as meaning "at least one".

Such a tethered-wing traction system benefits from automated capture of the folding lines with a high level of security irrespective of the external conditions relating for example to the weather, to the movements of the vehicle or the ship, etc.

Such a traction system can therefore be entirely automated. The intervention of an operator is then not required to deploy or fold it. Specifically, the capture of the folding lines is a critical point in the automation of such a system, since the fastening of these lines, which are by definition flexible and moving, is difficult and, in the prior art, generally requires human intervention to secure the capture of the folding lines, for example by virtue of attachments of the snap hook type, or also requires complex and prominent immobilizing devices which require the lines to be stretched in order to automatically capture them.

The invention notably makes it possible to utilize the mooring of the leading edge of the traction wing to the mooring mast (during the deployment or folding phases) to securely implement the capture and guidance of the folding lines irrespective of the position of the latter and without placing them under stress.

The invention makes it possible to fold the traction wing by disposing the folding lines vertically along the mooring mast, after they have been captured by virtue of the capturing device, by simply sliding the one or more folding carriages.

The means for capturing the folding lines make it possible to capture multiple folding lines simultaneously, while still ensuring individual management of these folding lines (or in pairs of folding lines) and to bring them sequentially along the mast after a single capturing operation.

The traction system according to the invention may have the following additional features, on their own or in combination:

- the system has a mooring line connecting the capturing device to the base platform;
- the capturing device is attached to a median zone of the leading edge; the folding lines each extend between the median zone and a lateral portion of the leading edge; the folding line which projects from the fastening rod is connected by its opposite end to one of the lateral portions;
- the capturing device has a body on which the fastening arm is mounted so as to be able to pivot between a flight position and a fastening position, in which the fastening rod is disposed substantially vertically;
- the fastening rod has a tube through which the folding line passes, this folding line being connected by its end to the fastening arm;
- the system has: a guide line connecting the capturing device to the flying trajectory control device; a shuttle which can slide along the guide line, this shuttle having a guide means through which the mooring line passes;
- the capturing device has a receiving portion for the shuttle, the shuttle being movable between a sliding configuration, in which it slides along the guide line, and a mooring configuration, in which the shuttle is disposed in its receiving portion;

the capturing device has a lever for controlling the pivoting of the fastening arm toward its fastening position, this lever being designed to be actuated by the shuttle when it reaches its mooring configuration;

the system has a mooring carriage designed to slide along the mooring mast, this mooring carriage having an interlocking interface for the capturing device;

the mooring carriage has means for immobilizing the capturing device against the interlocking interface;

the immobilizing means have an immobilizing hook which is movable between a retracted position and an immobilizing position, in which the immobilizing hook locks the fastening arm against the interlocking interface;

the shuttle has a convex shape designed to be received in a concave shape of the interlocking interface, when the shuttle is in the mooring configuration;

the shuttle has an oblong shape;

the folding lines are arranged in pairs, the folding lines of a pair connecting the capturing device to points on the leading edge that are symmetrically on either side of the capturing device; the capturing device has two fastening arms each provided with as many fastening rods as there are pairs of folding lines;

the fastening rods are disposed in stepped fashion;

the system has as many folding carriages as pairs of folding lines, each folding carriage having a pair of capturing hooks which can be moved between a retracted position and a capturing position, in which the capturing hooks of a pair surround the fastening rods of the two fastening arms;

the traction wing has a furling line designed to furl the traction wing; the capturing device has a furling rod, the furling line projecting in the continuation of the furling rod; the traction system has a furling carriage designed to slide along the mooring mast, the furling carriage having a furling hook which is movable between a retracted position and a capturing position, in which the furling hook surrounds the furling rod;

the capturing device has a clamping means designed to take up a clamping position in which the mooring line is kept fixed in place on the capturing device, and designed to take up a release position in which the mooring line slides freely in relation to the capturing device;

the mooring line is continued beyond the capturing device by an additional portion attached to the traction wing, the mooring line being designed to perform an additional action on the form of the traction wing when the clamping means is in the release position;

the capturing hook is controlled by a mechanism actuated by another carriage designed to slide along the mooring mast.

BRIEF DESCRIPTION OF THE DRAWINGS

Other features and advantages of the invention will emerge from the following nonlimiting description with reference to the appended drawings, in which:

FIG. 3 shows a front view of the traction wing of the traction system from FIGS. 1 and 2;

FIG. 4 shows a side view of the traction system during a phase of folding the traction wing;

FIG. 5 is a partial perspective view of the traction wing as it is being folded;

FIG. 6 shows a side view of the traction system during another phase of folding the traction wing;

FIG. 7 illustrates the traction wing folded along the mooring mast;

FIG. 8 is an enlarged view of the traction wing showing a capturing device which is connected to the leading edge of the traction wing;

Elements that are similar and shared by various embodiments bear the same reference numbers in the figures.

DETAILED DESCRIPTION

Figure 1:
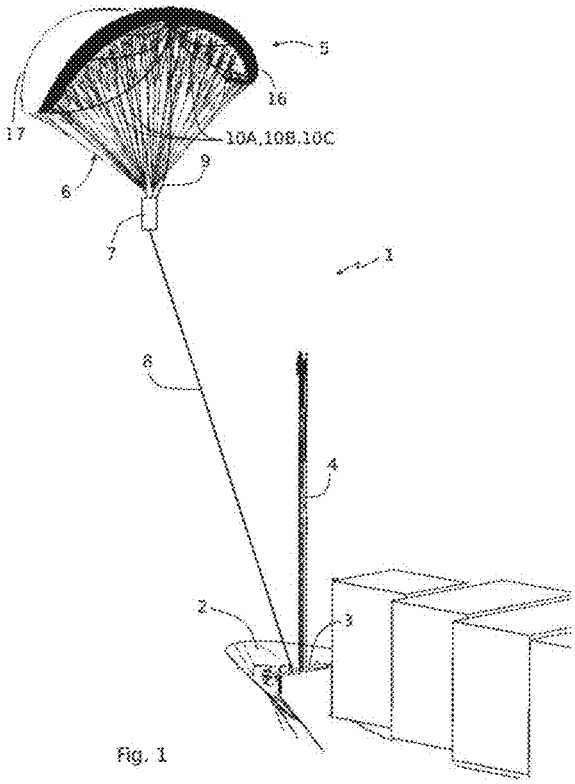
FIG. 1 is a perspective view of a traction system according to the invention.

FIG. 1 illustrates a tethered-wing traction system 1 mounted on a ship 2 which, in this example, is an ocean freight ship (in FIG. 1, only the front of the ship has been shown).

In the present example, the traction system 1 is mounted on the bow of the ship 2 and is actuated as a complementary propulsion means for the ship that makes it possible to save fuel. In this context, the traction system 1 is dimensioned depending on the tonnage of the ship to be hauled and is intended to be deployed and folded automatically.

In a variant, this traction system 1 may be used for any other application in which such an automatically foldable and deployable traction system is desired, for example as main propulsion means for a ship, for the propulsion of any other vehicle, for the generation of electricity, etc.

The traction system 1 has a base platform 3 which in this instance is fixed in place on the deck of the ship 2 and on which is mounted a mooring mast 4 provided for automatic folding and deployment operations of the system.

The traction system 1 also has a traction wing 5 which is designed to generate a traction force under the effect of the wind. In the present example, the traction wing 5 is a sail of the paraglider type. Any other flying equipment designed to generate a traction force under the effect of the wind can alternatively be employed, such as kites, gliding equipment, sails of the kite type, etc. The traction wing 5 conventionally has a leading edge 16 intended to be exposed to the ambient wind and an opposite edge, referred to as trailing edge 17.

The traction wing 5 is connected by an assembly of suspension lines 6 to a flying trajectory control device 7 which is designed to act on the suspension lines 6 to steer the flight of the traction wing 5.

The traction system 1 also has a traction line 8 connecting the flying trajectory control device 7 to the base platform 3. The traction force generated by the traction wing 5 is transmitted by the traction line 8 to the ship 2 to propel the latter, and the traction line is dimensioned accordingly. Within the context of the traction of an ocean freight ship, the traction line may be for example a textile cable of which the diameter may reach several centimeters.

The flying trajectory control device 7 makes it possible to steer the flight of the traction wing 5 in order to orient and position the traction wing and possibly to cause the traction wing 5 to describe flight paths that make it possible to increase the traction force on the ship. The control of the trajectory of the traction wing 5 is obtained in this instance by controlling the length of certain movable suspension lines, in a way which is conventional in the field of flying wings. The set of suspension lines 6 specifically has fixed suspension lines (that is to say that have a fixed length between their attachment to the traction wing 5 and their attachment to the flying trajectory control device 7) and movable suspension lines of variable length. The flying trajectory control device 7 is thus designed to pull on certain movable suspension lines and/or to slacken other movable suspension lines such that the aerodynamic profile of the traction wing 5 is modified with a view to controlling its lift, its trajectory, etc. The modification of the profile of a traction wing to control its trajectory is performed conventionally and will not be described in more detail here.

The traction wing 5 also has a guide line 9 and multiple folding lines 10A, 10B, 10C, which are all secured to the leading edge 16 by at least one of their ends.

Figure 2:
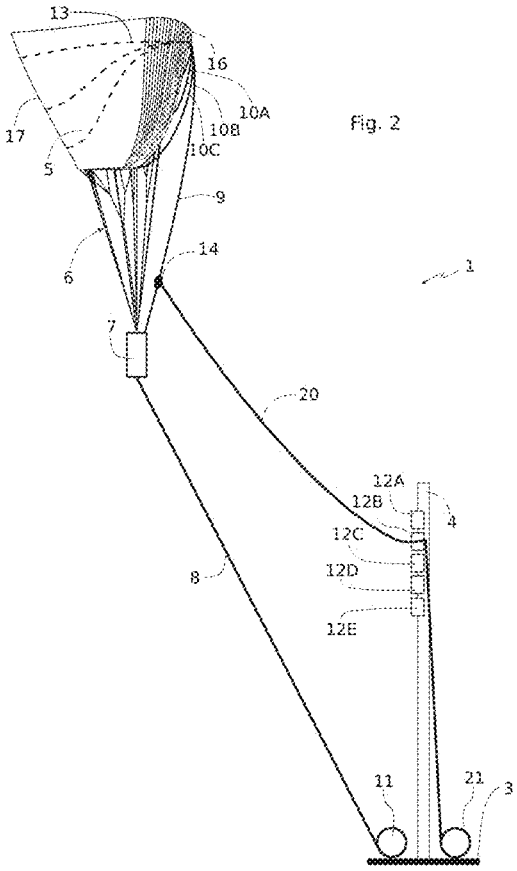
FIG. 2 illustrates a side view of the traction system.

FIG. 2 is a profile view of the traction system 1 in a phase of traction of the ship, as in FIG. 1. FIG. 2 also schematically illustrates constituent elements of the traction system 1.

The traction line 8 is connected to the base platform 3 via a winch 11 controlled by a motor, for example an electric or hydraulic motor, which is designed to unwind the traction line 8 to allow the traction wing 5 to gain altitude, or conversely to wind up this traction line 8 in order to bring the traction wing 5 towards the base platform 3.

FIGS. 1 and 2 illustrate the traction system 1 in a traction configuration, the traction wing 5 being deployed and in flight, and the system contributing to the propulsion of a ship.

The traction wing 5 has a furling line 13 which is divided into multiple lines (shown in dashed lines in FIG. 2) of which the ends are connected to the trailing edge 17 of the wing 5. This furling line 13 can be captured at the leading edge 16 of the traction wing 5, and traction on this furling line 13 causes the wing 5 to be furled by compression with the aim of stowing it away.

The traction system 1 has carriages 12A, 12B, 12C, 12D, 12E, five of them in the present example. These carriages are fixed slidingly on the mooring mast 4 and each has a drive such that the position of each carriage along the mooring mast 4 can be managed. These carriages are provided to capture and guide the folding lines 10A, 10B, 10C and the furling line 13 during the deployment or folding phases described later on.

These carriages are arranged as follows:

- the carriage 12A is a furling carriage and is designed to capture the furling line 13;
- the carriage 12B is a mooring carriage and is designed to ensure the mooring of the leading edge 16 of the traction wing 5;
- the carriage 12C is a first folding carriage and is designed to capture the first pair of folding lines 10A;
- the carriage 12D is a second folding carriage and is designed to capture the second pair of folding lines 10B;
- the carriage 12E is a third folding carriage and is designed to capture the third pair of folding lines 10C.

In a variant, the traction system 1 has as many carriages as are necessary to capture the folding or furling lines, the number of which can vary in relation to the example described.

The folding lines 10A, 10B, 10C are arranged in pairs, as illustrated in FIG. 3. In the present description, the leading edge 16 of the traction wing 5 is divided into a median zone 15 and two lateral edges 19 extending on either side of this median zone 15, between the median zone 15 and each of the lateral ends 18 of the leading edge 16.

In this FIG. 3, the front view of the traction wing 5 illustrates the routing of the folding lines 10A, 10B, 10C and their arrangement with respect to the leading edge 16:

- a first pair of folding lines 10A has two lines each having a first end connected at the median zone 15 of the leading edge 16, and a second end which is directly connected to the leading edge 16, at a certain distance from the median zone 15, in one of the lateral portions 19 of the leading edge 16;
- a second pair of folding lines 10B has two lines each having a first end connected at the median zone 15, and a second end directly connected to the leading edge 16, in one of the lateral portions 19, and in this example approximately in the middle of each lateral portion 19, that is to say approximately halfway between the lateral zone 15 and the lateral end 18;
- a third pair of folding lines 10C has two lines each connecting the median zone 15 to a portion of the leading edge 16 which is in the vicinity of the lateral end 18.

FIG. 3 also illustrates the routing of the guide line 9 between the central portion 15 and the flying trajectory control device 7.

With reference again to FIG. 2, the traction system 1 has a mooring line 20 which is wound up on a mooring winch 21 mounted on the base platform 3. The mooring line 20 leaves the winch 21 and is then guided into the mooring carriage 12B by one or more pulleys (or by low-friction elements, or any other element that makes it possible to slidingly route the mooring line 20 into the mooring carriage 12B). The mooring line 20 then enters a shuttle 14 which can slide along the guide line 9.

Taking the traction configuration of FIGS. 1 and 2 as a starting point, the traction wing 5 can be folded according to the process described below.

From the positions of FIGS. 1 and 2, the winches 11 and 21 are first of all made to retract the traction line 8 and the mooring line 20 such that the flying trajectory control device 7 comes to rest on the base platform 3, while the shuttle 14 rises along the guide line 9 as the traction wing 5 descends.

This operation continues as far as the position of FIG. 4, in which:

- the flying trajectory control device 7 rests on the base platform 3, for example on a suitable support (not shown);

the shuttle 14 has slid upward, over the entire length of the guide line 9, to its end which is in the vicinity of the median zone 15.

The mooring line 20 enters the mooring carriage 12B and holds the leading edge 16 against the mooring carriage 12B by traction. The traction wing 5 is then locked in this moored position (as will be described later on), the tension on the mooring line 20 is no longer necessary, and the lines can be captured.

To capture the lines (these operations do not necessarily take place in this order):

the furling carriage 12A captures the furling line 13;

the first folding carriage 12C captures the first pair of folding lines 10A;

the second folding carriage 12D captures the second pair of folding lines 10B;

the third folding carriage 12E captures the third pair of folding lines 10C.

The lines are captured by virtue of hooks on the carriages, and a capturing device, as set out below.

The folding carriages 12C, 12D, 12E then start to descend along the mooring mast 4 by sliding their hooks along lines which have been caught.

FIG. 5 is a perspective view illustrating this operation of descent of the folding carriages. Each of the folding carriages 12C, 12D, 12E then entrains each of the folding lines gradually towards a configuration in which the lines are stretched vertically from the median zone 15 (which is moored to the mooring carriage 12B, which remains fixed in place) along the mooring mast 4. This operation makes it possible to bring back the lateral portions 19 vertically along the mooring mast 4.

FIGS. 6 (side view) and 7 (perspective view) illustrate the traction wing 5 after this folding operation, that is to say when the folding carriages 12C, 12D, 12E are each in their respective lowest position.

The traction wing 5 is then folded along the mooring mast 4, that is to say that the two lateral portions 19 of the leading edge 16 extend vertically along the mooring mast 4, while the median zone 15 is kept moored to the mooring carriage 12B.

From this position in FIGS. 6 and 7, the wing 5 can then be furled. The furling carriage 12A (which has captured the furling line 13) is then made to slide upward along the mooring mast 4 and thus exerts traction on the furling line 13, thereby causing the traction wing 5 to be furled. In the present example, the furling is done by compression, by moving the trailing edge 17 close to the leading edge 16.

With reference to FIG. 6, the traction wing 5 is moored to the mooring carriage 12B by the interaction of the mooring line 20, the mooring carriage 12B, the shuttle 14 and a capturing device 22.

FIG. 8 is a detail view of FIG. 3, illustrating the traction wing 5 in a front view and showing the median zone 15, and the attachment of the folding lines 10A, 10B, 10C and the furling line 13 to the median zone 15 of the leading edge 16 via the capturing device 22.

Figure 12:
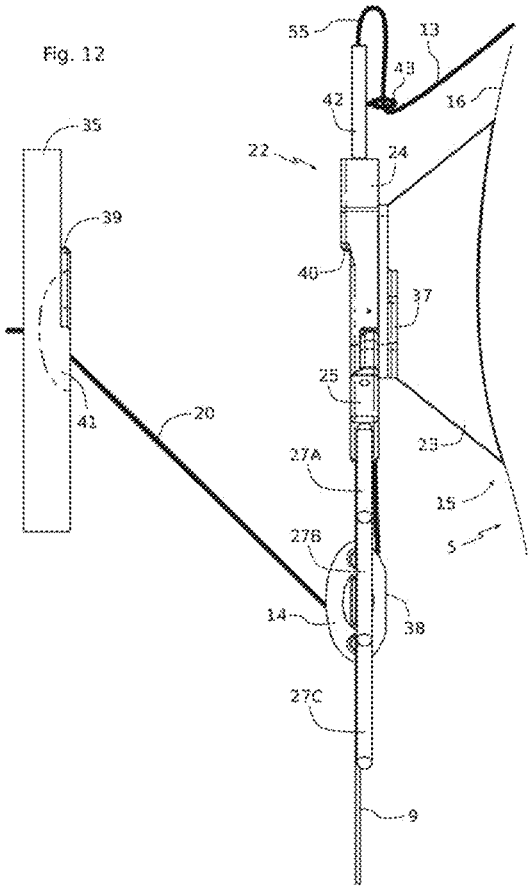
FIG. 12 is a side view of the capturing device.

The capturing device 22 is connected to the leading edge 16 of the traction wing 15 in the median zone 15 by a pylon 23 (visible notably in the side view of FIG. 12). The pylon 23 is thus referred to analogously to the pylon of an aircraft, that is to say the engine pylon, in aeronautical terms. The pylon 23 is preferably made of a rib of lightweight and strong material, such as a carbon-fiber composite material. The pylon 23 is fixed to the capturing device 22 and to a reinforcement sewn to the leading edge 16 of the traction wing 5.

In a variant, the capturing device 22 may be connected to the leading edge 16 by any other flexible or stiff means, such as textile ties or any other element that makes it possible for traction on the capturing device 22 to cause traction on the leading edge 16.

The capturing device 22 has a body 24 and two fastening arms 25 mounted on this body 24 so as to be able to pivot each about a pin 26. Each of the fastening arms 25 has a first fastening rod 27A, a longer second fastening rod 27B, and an even longer third fastening rod 27C (the fastening rods 27A, 27B, 27C are seen in section in FIG. 8). This disposition, in which the juxtaposed fastening rods have an increasing, or decreasing, length, is referred to as "stepped" in this instance.

In the present example, the fastening rods 27A, 27B, 27C are made up of tubes force-fitted in bores provided to that end in the fastening arms 25.

The fastening arms are movable in relation to the body 24 between a flight position (that of FIG. 8) and a fastening position (that of FIG. 13), in which the fastening rods 27A, 27B, 27C are disposed substantially vertically (when the traction wing 5 is in its normal moored position).

Each fastening arm 25 moreover has a lever 28, that is to say a portion extending beyond the pin 26 and making it possible to act on the fastening arm 25 to fold it.

Each folding line 10A, 10B, 10C which joins the median zone 15 is connected to a fastening rod 27A, 27B, 27C so as to protrude in the continuation of this fastening rod. In other words, the end of the fastening rod is continued by the folding line.

In the present example, in which the fastening rods are formed by tubes, the folding line is advantageously inserted in the tube and passes all through the tube to a fixing zone 29 of the fastening arm 25.

Figure 9:
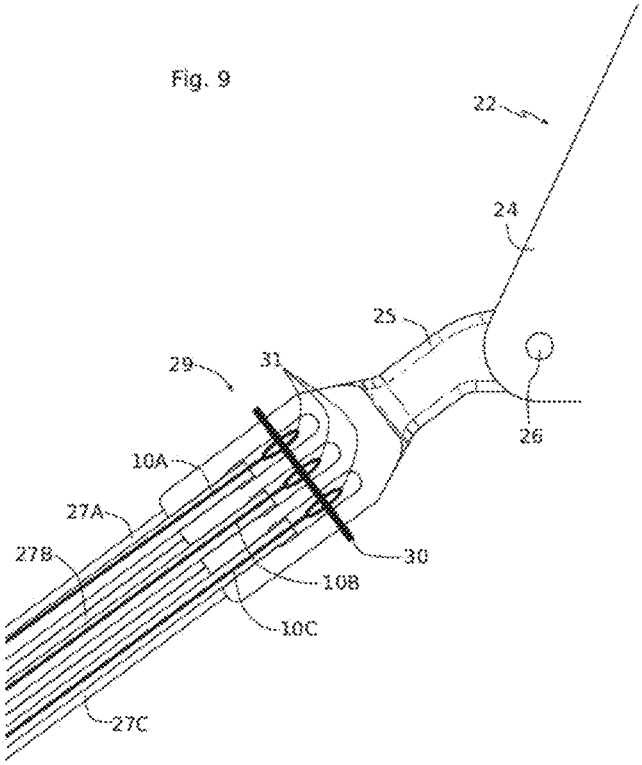
FIG. 9 is a detail view of FIG. 8.

FIG. 9 is a detail view of the fixing zone 29. Each folding line 10A, 10B, 10C passes through the tube of the fastening rod 27A, 27B, 27C to lead into the fixing zone 29. The end of each folding line 10A, 10B, 10C is held in place by a through-pin 30 that passes for example through a spliced eye 31 of the folding line 10A, 10B, 10C.

The pivot connection between the fastening arms 25 and the body 24 allows the fastening arms 25 to naturally take the spaced-apart position illustrated in FIG. 8 during the flight of the traction wing 5, the fastening arms 25 thus following the opening dictated by the folding lines 10A, 10B, 10C which extend in the direction of their other end, which is connected further on to the leading edge 16. The capturing device 22 may additionally have an elastic element (spring or the like) that urges the fastening arms 25 toward their flight position in FIG. 8.

The function of this flight position of the fastening arms 25 is to further secure the automatic fastening of the lines by limiting the risk of the fastening arms 25 and the fastening rods 27A, 27B, 27C becoming entangled with the other lines, such as the guide line 9 and the mooring line 20.

The shuttle 14 is also shown in section in FIG. 8. The shuttle 14 has two sliding orifices 32 and in this case has an oblong shape with two lateral flats 33. The oblong shape of the shuttle 14 enables guidance and angular orientation (about a horizontal axis) of the capturing device 22.

In this instance, the guide line 9 is made up of a pair of lines stretched between the body 24 and the flying trajectory control device 7. In the present example, the pair of guide lines 9 forms a loop around a stop 34 of the body 24.

The guide line 9 is thus attached to the median zone 15 via the capturing device 22.

The mooring line 20 passes through the shuttle 14 and is connected to the body 24. The shuttle 14 has a guide means through which the mooring line passes 20 and which makes it possible for the mooring line 20 to slide freely. In the present example, this guide means is formed by a sheave 63 (see FIG. 15) and in a variant can be formed by any type of guide means, such as pulleys or low friction elements. The mooring line 20 thus extends from the mooring carriage 12B and passes slidingly through the shuttle 14, being guided in the direction of the body 24.

Figure 10:
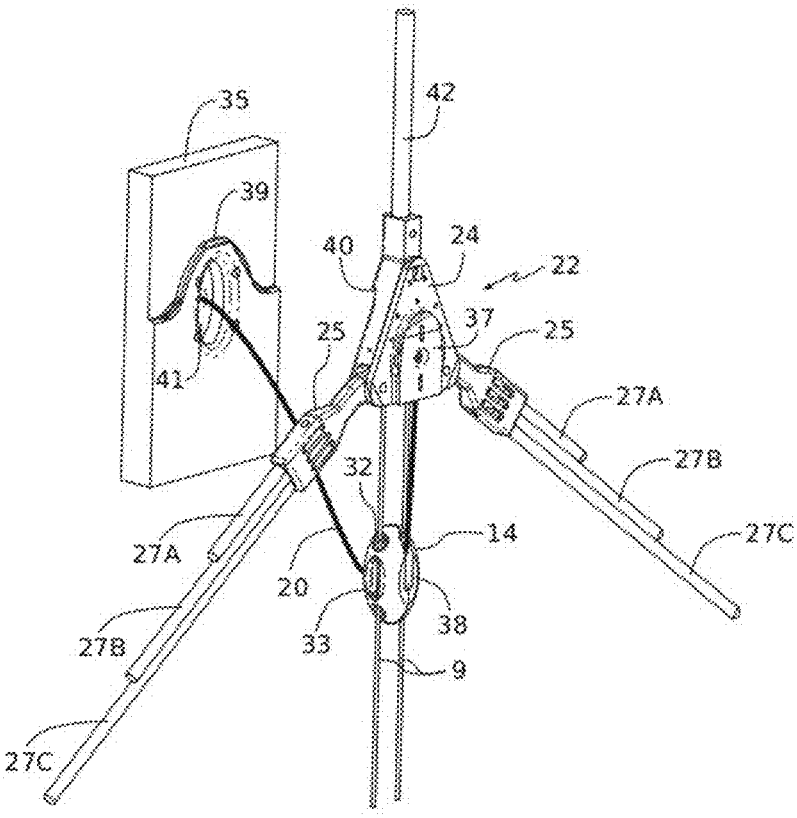
FIG. 10 is perspective view of the capturing device.
Figure 11:
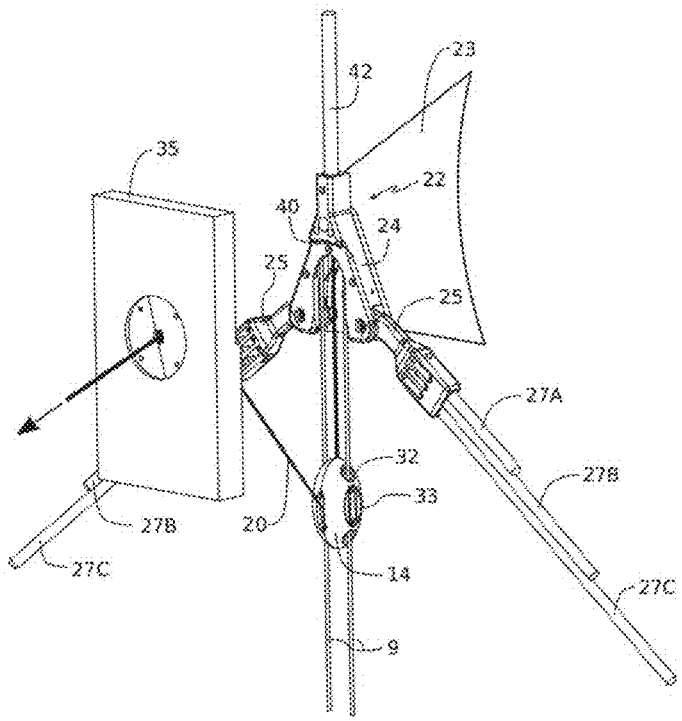
FIG. 11 is another perspective view of the capturing device.

FIGS. 10 and 11 illustrate the capturing device 22 in perspective from two different viewing angles. In FIG. 10, the visible face of the capturing device 22 is that which faces the traction wing 5 (the yoke 23 not having been shown).

In FIG. 11, the visible face of the capturing device 22 is that which faces the mooring carriage 12B.

The capturing device 22 is shown facing an interlocking interface 35 which is fixed to the mooring carriage 12B (the rest of the mooring carriage 12B has not been shown).

The position of FIGS. 10 and 11 illustrates an intermediate position of the operation for mooring the traction wing 5 during the process for folding it. In this position, the traction line 8 has brought along the traction wing 5 such that its leading edge 16 faces the mooring carriage 12B, and the mooring line 20 is in the course of being wound up by its winch 21, traction then being exerted on the mooring line 20 (illustrated by the arrow in FIG. 11).

This operation causes the shuttle 14 to rise along the guide line 9. The doubling of the guide line 9 makes it possible here for the shuttle 14 to slide without pivoting about a vertical axis. A sliding connection is thus ensured, instead of a sliding pivot connection.

The capturing device 22 has, in the body 24, a receiving portion 36 intended to receive the shuttle 14. The receiving portion 36 is delimited by lateral walls interacting with the two flats 33 of the shuttle 14, and by a bottom wall 37 itself interacting with another flat 38 of the shuttle 14.

FIG. 12 illustrates the parts of FIGS. 10 and 11 in profile views. The interlocking interface 35 has elements for mooring the capturing device 22 in a predefined position. In the present example, these elements have an indentation 39 which complements an indentation 40 in the body 24. The shuttle 14 is also part of these positioning elements, since it is intended to engage in an impression 41 in the interlocking interface 35. The indentation 40 moreover has a significant advantage in terms of reacting forces, since the interaction of the indentations 39 and 40 makes it possible to react all the vertical forces which are exerted on the capturing device 22 during the folding operations, it being possible for these forces to be greater than 15 kN.

The impression 41 has inner walls for receiving and positioning the shuttle 14. The ovoid shape of the shuttle 14 and the complementary shape of the impression 41 ensure the predefined positioning when the capturing device 22 is being moored to the interlocking interface 35.

FIG. 12 also illustrates the arrangement of the furling line 13. The capturing device 22 has a furling rod 42 protruding vertically above the body 24. The furling line 13 protrudes in the continuation of the furling rod 42. In the present example, the furling rod 42 is formed by a tube fitted in the body 24, the furling line entering this tube and its end being fixed to the body 24.

Between its attachment to the furling rod 42 and its journey toward the trailing edge 17, the furling line 13 forms a loop 55 and enters a ring 43 which is integral with the tube 42. The ring 43 is for example a low-friction ring, or may be formed by a tube or a pulley. Traction on the loop 55 thus causes traction on the furling line 13 and therefore furling of the traction wing 5.

Figure 13:
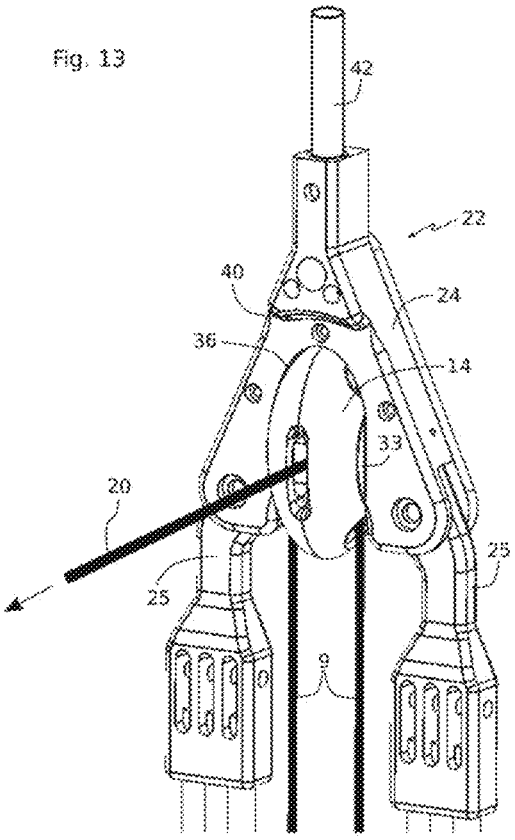
FIG. 13 is a partial perspective view of the capturing device.

Furthermore, the traction on the mooring line 20 during the phase of mooring the traction line causes the shuttle 14 to rise and ends with the shuttle 14 entering the receiving portion 36, as illustrated in FIG. 13. The shuttle 14 is then immobilized in the receiving portion 36 by virtue of the dimensional fit that makes it possible for the surface of the flats 33, 38 to bear against the inner surfaces of the receiving portion 36.

The shuttle 14 is thus movable between a sliding configuration, in which it slides along the guide line 9, and a mooring configuration, in which the shuttle 14 is disposed in its receiving portion 36.

The entry of the shuttle 14 into the receiving portion 36 also activates the levers 28, this causing the fastening arms 25 to close, that is to say be transferred into the vertical position, and to be held in this position by way of the presence of the shuttle 14.

When the capturing device 22 and the shuttle 14 are in the position of FIG. 13, the continuing traction on the mooring line 20 causes the capturing device 22 to move closer to the interlocking interface 35 until these two elements are coupled.

The capturing device 22 and the interlocking interface 35 are coupled in the required predetermined position by the interlocking of the indentations 39, 40 and by the interlocking of the shuttle 14 in the impression 41. The ovoid shape of the shuttle 14 makes it possible, during the mooring operation, to bring the capturing device 22 toward this predetermined position even if the mooring line 20 is twisted, that is to say even in the event of rotation of the capturing device 22 about the mooring line 20. The convex shape of the shuttle 14 is thus designed to be received in a concave shape of the interlocking interface 35 when the shuttle is in the mooring configuration, if required the shuttle 14 causing the assembly formed by the capturing device 22 and the shuttle 14 to rotate by virtue of the ovoid shape of the shuttle 14, under the traction of the mooring line 20.

Figure 14:
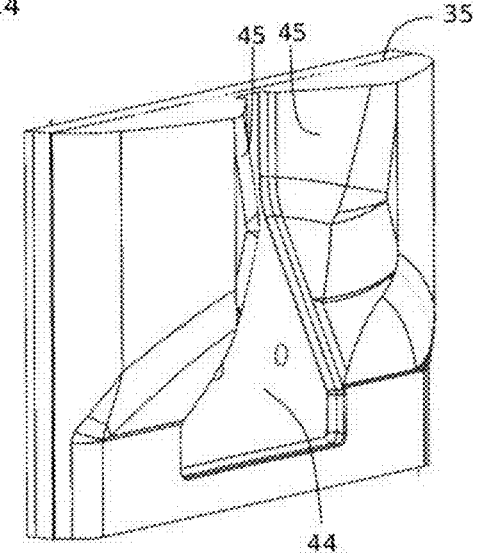
FIG. 14 illustrates a variant for the interlocking interface of the folding carriage.

FIG. 14 illustrates a variant embodiment for the interlocking interface 35 in which the latter has a complementary receiving portion 44 to the body 24 and inclined walls 45 intended to channel the trajectory of the capturing device 22 toward this receiving portion 44 during the phase of coupling the capturing device 22 and the interlocking interface 35.

Figure 15:
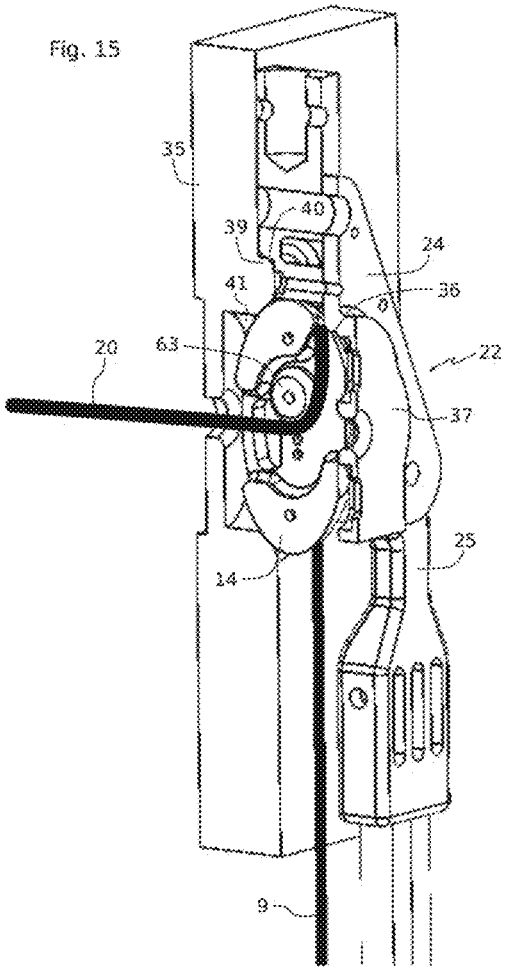
FIG. 15 is a sectional view of FIG. 13.

FIG. 15 is a sectional view of the capturing device 22 (and the shuttle 14) after it has been coupled to the interlocking interface 35. In this position, the leading edge 16 of the traction wing 5 is moored to the mooring carriage 12B via the capturing device 22. Maintaining a traction force on the mooring line 20 no longer causes the displacement of the capturing device 22 (which butts against the interlocking interface) but maintains the mooring.

Figure 16:
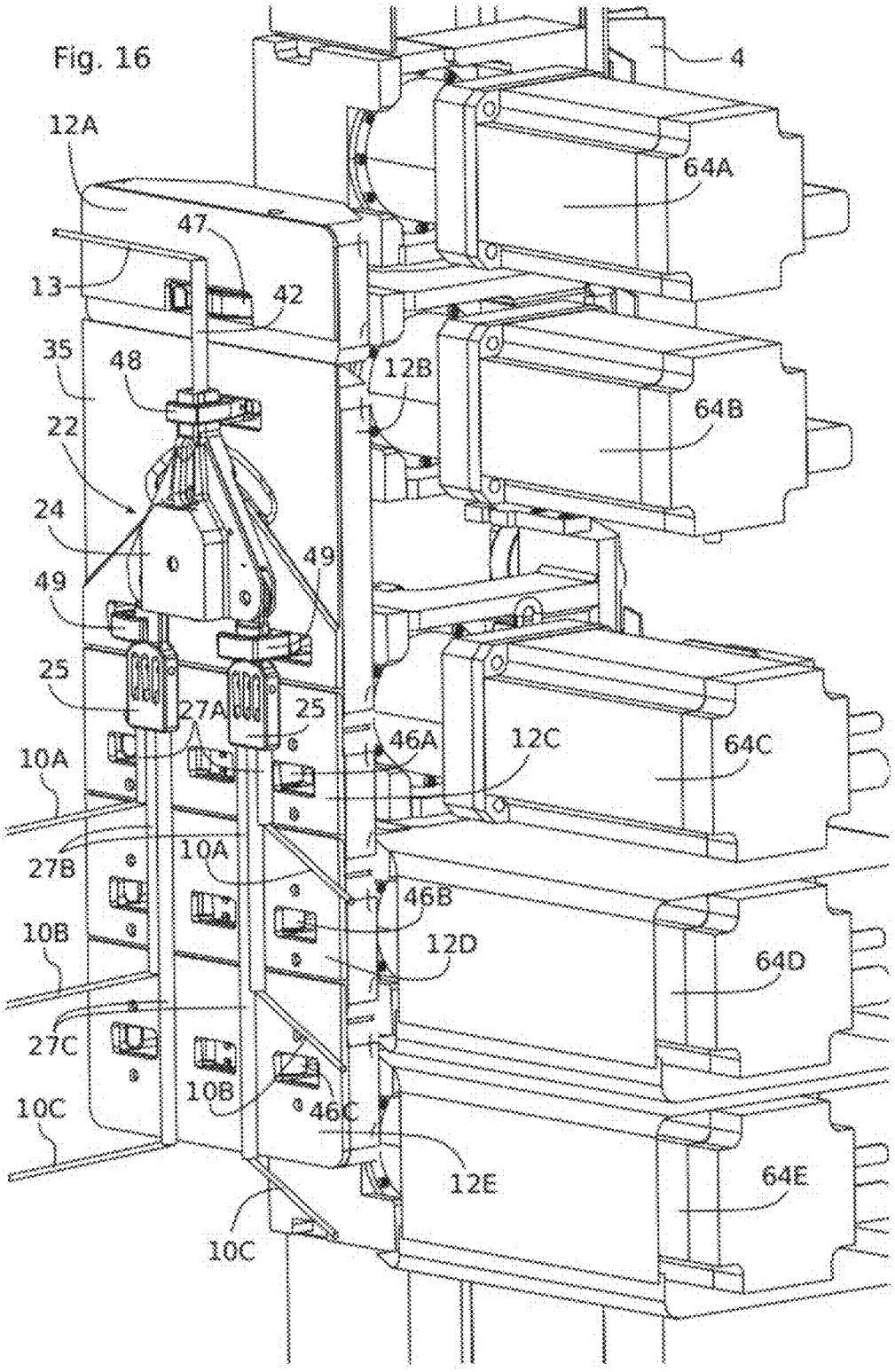
FIG. 16 shows the capturing device and the carriages of the traction system during a step of folding the traction wing.

FIG. 16 illustrates the capturing device 22 thus moored to the mooring carriage 12B. This figure also illustrates the other carriages 12A, 12C, 12D, 12E. Each of the carriages can slide along the mooring mast 4 controlled by virtue of actuators 64A, 64B, 64C, 64D, 64E. In the present example, the actuators 64A, 64B, 64C, 64D, 64E are electric motors each controlling a pinion which meshes with a rack fixed to the mooring mast 4 (the pinions and racks are not visible in the figures).

The mooring carriage 12B has an upper immobilizing hook 48 and a pair of lower immobilizing hooks 49, which are movable between a retracted position, in which they are spaced apart from the capturing device 22, and an immobilizing position (that shown in FIG. 16), in which they respectively lock the body 24 and the fastening arms 25 against the interlocking interface 35.

Each of the folding carriages 12C, 12D, 12E has a pair of capturing hooks 46A, 46B, 46C, each of these pairs of capturing hooks being intended to hook the corresponding pair of folding lines 10A, 10B, 10C. These hooks 12C, 12D, 12E are in the retracted position in FIG. 16.

The furling carriage 12A has a capturing hook 47 intended to actuate the furling line 13 by way of the loop 55. The capturing hook 47 is also retracted in FIG. 16.

The hooks 46A, 46B, 46C, 47, 48 are hooks which can pivot in the integral yokes of the corresponding carriage.

During the process of folding the traction wing 5, once the capturing device 22 is coupled to the interlocking interface 35, the immobilizing hooks 48, 49 of the mooring carriage 12B are activated toward their immobilizing position to fix the capturing device 22 to the interlocking interface 35, as illustrated in FIG. 16. After this step, traction of the mooring line 20 is no longer necessary to maintain the mooring.

The upper immobilizing hook 48 clamps the upper part of the body 24 while the lower immobilizing hooks 49 clamp the fastening arms 25 at the fixing zone 29, that is to say above the fastening rods 27A, 27B, 27C.

Figure 17:
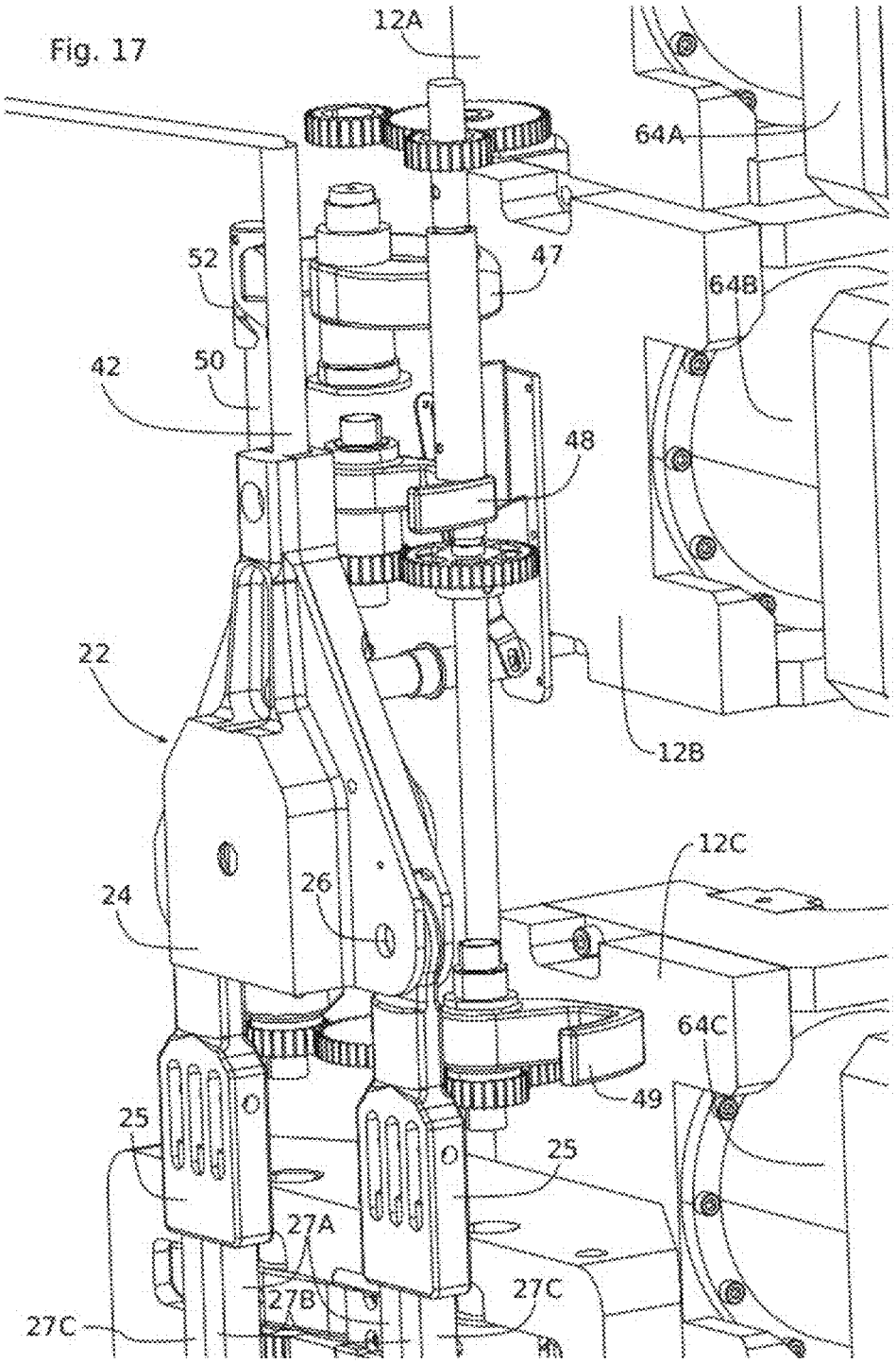
FIG. 17 shows the capturing device and the carriages of the traction system during another step of folding the traction wing.

The hooks 48, 49 can be activated by any means, such as a pivot means controlled by an electric motor, or remote-controlled magnetic actuating means. In the present example, with reference to FIGS. 17 and 18, the hooks 48, 49 are actuated by virtue of the movement of the furling carriage 12A. FIG. 17 shows the carriages in a transparent view to make the mechanism visible. The hooks 48, 49 are each mounted rotatably on the carriage and are actuated either by a shaft or by pinions. A control shaft 50 makes it possible to actuate the rotation of the set of three hooks 48, 49 by virtue of the arrangement of the pinions.

Figure 18:
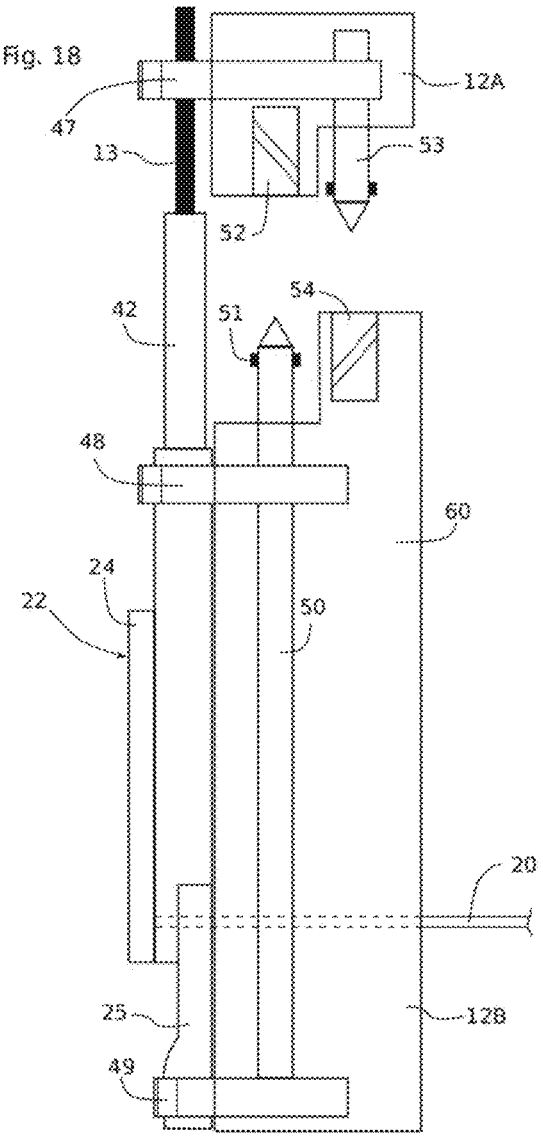
FIG. 18 is a schematic side view of the elements of FIG. 17.

FIG. 18 is a schematic view showing the operating principle of these elements. The control shaft 50 has at its end a lug 51 designed to interact with a helical camway 52, which is integral with the furling carriage 12A, such that the movement of the furling carriage 12A closer to the mooring carriage 12B causes the control shaft 50 to rotate and thus drives the hooks 48, 49 toward their retracted position, and the movement of the furling carriage 12A away from the mooring carriage 12B drives the hooks 48, 49 toward their immobilizing position. An elastic element, such as a torsion spring, urges the hooks 48, 49 toward their immobilizing position.

As illustrated in FIG. 18, the same type of mechanism makes it possible, with continued movement of the furling carriage 12A away from the mooring carriage 12B, to also drive the furling hook 47 toward its capturing position by virtue of a control shaft 53 interacting with a helical camway 54.

In the same way as before, the capturing hooks 46A, 46B, 46C of the folding carriages 12C, 12D, 12E may also be managed by any means that make it possible to close them over the fastening rods 27A, 27B, 27C. In the present example, the capturing hooks 46A, 46B, 46C are preferably made to transfer to their capturing position by moving the corresponding folding carriage away from the preceding carriage, by virtue of the same type of control as above: with a control shaft, lug and helical camway.

Figure 19:
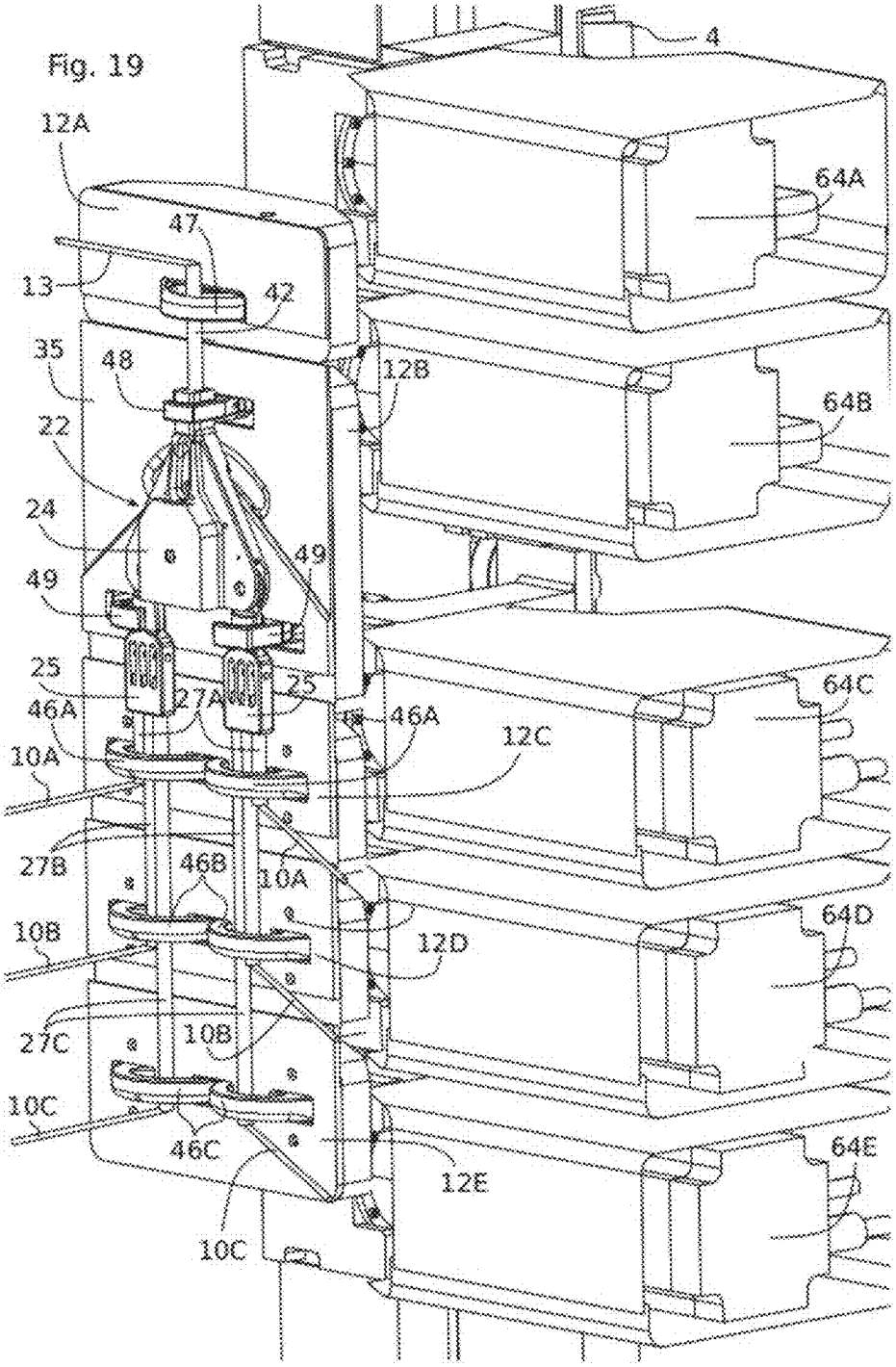
FIG. 19 shows the capturing device and the carriages of the traction system during another step of folding the traction wing.

Thus, with reference to FIG. 19, the furling carriage 12A is first of all moved slightly away from the mooring carriage 12B, this causing the immobilizing hooks 48, 49 to close and the capturing device 22 to be immobilized. The furling carriage 12A then remains in this position, the hook 47 being in the retracted position.

The folding carriages 12C, 12D, 12E then each start to descend along the mooring mast 4 while moving away from one another such that the pairs of hooks 46A, 46B, 46C close over the fastening rods 27A, 27B, 27C, as illustrated in FIG. 19.

Each hook 46A of the first folding carriage 12C closes over the three fastening rods 27A, 27B, 27C, that is to say just above the ends of the first fastening rods 27A.

Each hook 46B of the second folding carriage 12D closes over two fastening rods 27B, 27C, that is to say just above the ends of the second fastening rods 27B.

Each hook 46C of the third folding carriage 12E closes solely over a third fastening rod 27C, just above the ends of the third fastening rods 27C.

In this position in FIG. 19, each of the pairs of folding hooks 46A, 46B, 46C is thus just above the run-out of the corresponding folding lines 10A, 10B, 10C.

From the position in FIG. 19, the folding carriages 12C, 12D, 12E continue to descend such that:

- the third folding lines 10C are stretched vertically by the capturing hooks 46C which descend along the mooring mast 4 by sliding along these folding lines 10C;
- the second folding lines 10B are stretched vertically by the capturing hooks 46B which descend along the mooring mast 4 by sliding along these folding lines 10B and the folding lines 10C previously made to run vertically by the capturing hooks 46C;
- the first folding lines 10A are stretched vertically by the capturing hooks 46A which descend along the mooring mast 4 by sliding along these folding lines 10A and the folding lines 10B, 10C previously made to run vertically by the capturing hooks 46B, 46C.

As the carriages descend, the hooks 46A, 46B, 46C thus slide on their corresponding folding line, making this folding line run vertically along the mooring mast 4.

This descent continues until the folded position in FIGS. 6 and 7 is reached.

Once the folded position has been reached, the traction wing 5 can then be furled. This operation is performed by the furling carriage 12A rising along the mooring mast 4, this first of all causing the furling hook 47 to close over the furling rod 42 (see FIG. 19). The continued rising of the furling carriage 12A then causes traction on the loop 55 (the loop 55 is visible in FIG. 12 and has not been shown in the other figures).

The capturing device 22 thus makes it possible to ensure rapid and secure mooring of the leading edge 16 of the traction wing 5 to the mooring carriage 12B and also ensures automatic and faultless hooking of each of the folding lines 10A, 10B, 10C and the furling line 13.

A second embodiment concerning the arrangement of the mooring line 20 will now be described with reference to FIGS. 20 and 21. According to this embodiment, the mooring line 20 is not attached permanently to the body 24 and makes it possible to perform an additional function.

Figure 20:
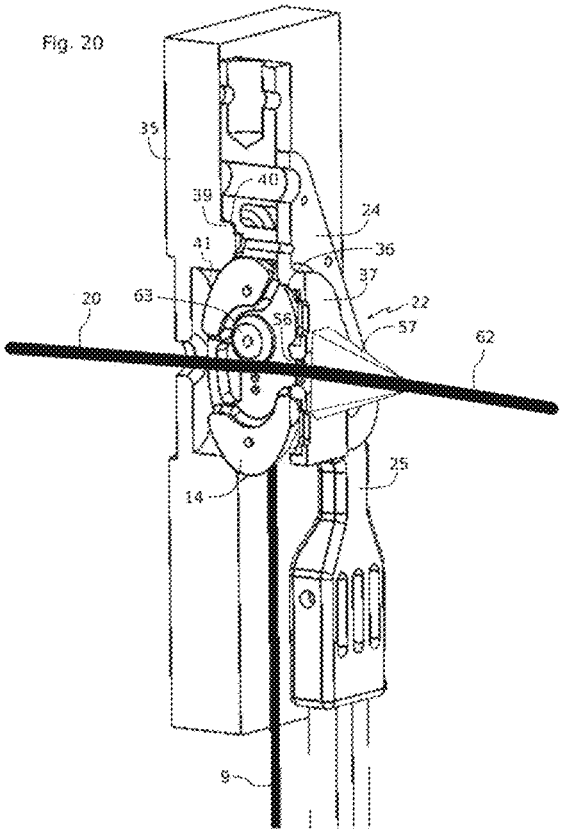
FIG. 20 is similar to FIG. 15 for a second embodiment of the capturing device.

FIG. 20 corresponds to FIG. 15 that was described above, with the variants of this second embodiment. The mooring line 20 passes through an orifice 56 formed in the bottom wall 37 of the body 24 and is continued by an additional portion 62 in the direction of the traction wing 5. At its run-out from the orifice 56, the mooring line 20 is fixed by a clamping means which in this instance has jaws 57 held closed by elastic elements.

The capturing device 22 thus has a clamping means designed to take up a clamping position in which the mooring line 20 is kept fixed in place on the capturing device 22, and designed to take up a release position in which the mooring line 20 slides freely in relation to the capturing device 20.

The continuation of the mooring line 20 beyond the jaws 57 allows this additional portion 62 of the mooring line 20 to perform an additional function within the traction wing 5. This function may for example relate to an action on the aerodynamic profile of the traction wing 5 or to a action of closing the trailing edge of the traction wing 5.

This additional function is performed by making the jaws 57 open and by exerting traction on the mooring line 20, this causing traction on this additional portion 62 of the traction line 20 and therefore the performance of this additional function, for example by way of traction which modifies the shape of the trailing edge 17.

The jaws 57 are made to open after the capturing device 22 has been immobilized by the immobilizing hooks 48, 49, such that the traction on the mooring line 20 is no longer useful for maintaining the mooring.

Figure 21:
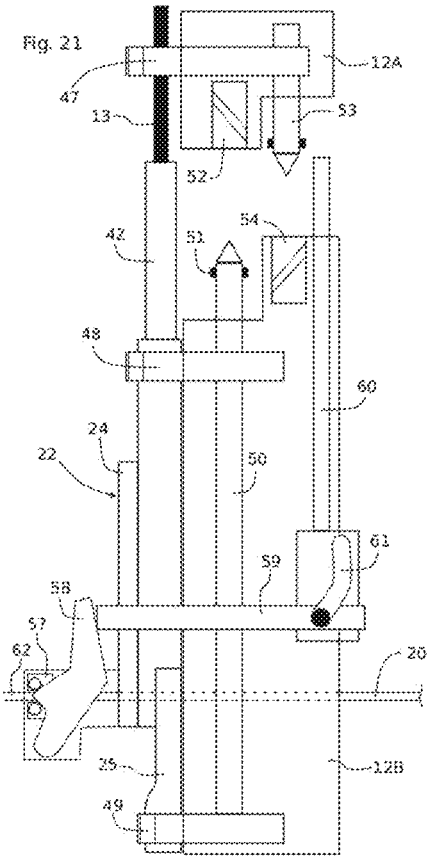
FIG. 21 is similar to FIG. 18 for a second embodiment of the capturing device.

FIG. 21 illustrates one embodiment of the jaws 57 and their control (in a schematic view similar to FIG. 18). The jaws 57 are in this instance associated with an opening lever 58 which makes it possible to open the jaws 57. The opening lever and the jaws 57 are urged by elastic elements toward their position corresponding to clamping of the mooring line 20.

The opening lever 58 is actuated by a rod 59 which interacts with a bar 60 having a camway 61 at its end. The bar 60, when it is pushed downward by the movement of the furling carriage 12A toward it, is intended to cause the rod 59 to retract (and therefore the opening lever 58 to be released), this causing the jaws 57 to close. Conversely, continuing to move the furling carriage 12A away from the mooring carriage 12B, after having immobilized the capturing device, causes the jaws 57 to open and thus the additional portion 62 of the mooring line 20 to be released.

In a variant, the jaws 57 can be controlled by any other means allowing the mooring line 20 to be separated from the capturing device 22 in order to perform an additional function within the traction wing 5.

At the end of these operations leading to the traction wing being folded (FIGS. 6 and 7) and furled, the process for folding the traction wing 5 is then continued until the traction wing 5 is stored, for example by sliding the set of carriages along the mast in order to stow the wing in a suitable container.

The process for folding the traction wing 5 is thus finished.

The process for deploying the traction wing 5, during the next use, is then performed with the same operations as those described above, executed in reverse order.

Variant embodiments may be implemented. For example, the lines may be directly attached to the end of the fastening rods or of the furling rod. The number of carriages, hooks and lines can of course vary in order to correspond to a particular application.

In addition, the clamping means which in this case is made up of jaws 57 may alternatively be formed by any other means for preventing traction of a line, for example by a textile-sleeve locking means.

The invention claimed is:

1. A tethered-wing traction system having:

a traction wing (5) to generate a traction force under the effect of the wind, the traction wing (5) having a leading edge (16) and a trailing edge (17);

a base platform (3) connected to the traction wing (5) via a traction line (8), the traction wing (5) is deployed and folded in relation to the base platform (3);

a mooring mast (4) for the traction wing (5) disposed on the base platform (3);

multiple folding lines (10A, 10B, 10C) each having an end fixed to the leading edge (16) of the traction wing (5), the ends being spaced apart from one another along the leading edge (16);

a folding carriage (12C, 12D, 12E) to slide along the mooring mast (4);

a capturing device (22) attached to the leading edge (16) of the traction wing (5) and has a fastening arm (25) provided with a fastening rod (27A, 27B, 27C), one of the folding lines (10A, 10B, 10C) projecting in the continuation of the fastening rod (27A, 27B, 27C); the folding carriage (12C, 12D, 12E) having a capturing hook (46A, 46B, 46C) that is movable between a retracted position and a capturing position, in which the capturing hook (46A, 46B, 46C) surrounds the fastening rod (27A, 27B, 27C).

2. The traction system as claimed in claim 1, further comprising a mooring line (20) connecting the capturing device (22) to the base platform (3).

3. The traction system as claimed in claim 2, further including:

a guide line (9) connecting the capturing device (22) to the flying trajectory control device (7);

a shuttle (14) that slides along the guide line (9), the shuttle (14) having a guiding device (63) through which the mooring line (20) passes.

4. The traction system as claimed in claim 3, wherein the capturing device (22) has a receiving portion (36) for the shuttle (14), the shuttle (14) moves between a sliding configuration, in which the shuttle slides along the guide line (9), and themooring configuration, in which the shuttle (14) is disposed in the receiving portion (36).

5. The traction system as claimed in claim 4, wherein the capturing device (22) has a lever (28) for controlling the pivoting of the fastening arm (25) toward the fastening position, the lever (28) actuates by the shuttle (14) when reaches its mooring configuration.

6. The traction system as claimed in claim 4, wherein the shuttle (14) has a convex shape suitable for being received in a concave shape of the interlocking interface (35) when the shuttle (14) is in the mooring configuration.

7. The traction system as claimed in claim 6, wherein the shuttle (14) has an oblong shape.

8. The traction system as claimed in claim 2, wherein the capturing device (22) has a clamping device (57) to take up a clamping position in which the mooring line (20) is kept fixed in place on the capturing device (22), and designed to take up a release position in which the mooring line (20) slides freely in relation to the capturing device (20).

9. The traction system as claimed in claim 8, wherein the mooring line (20) is continued beyond the capturing device (22) by an additional portion (62) attached to the traction wing (5), the mooring line (20) being designed to perform an additional action on the form of the traction wing (5) when the clamping device (57) is in the release position.

10. The traction system as claimed in claim 1, wherein:

the capturing device (22) is attached to a median zone (15) of the leading edge (16);

each one of the folding lines (10A, 10B, 10C) extend between the median zone (15) and a lateral portion (19) of the leading edge (16);

the folding line (10A, 10B, 10C) which projects from the fastening rod (27A, 27B, 27C) is connected by its opposite end to one of the lateral portions (19).

11. The traction system as claimed in claim 1, wherein the capturing device (22) has a body (24) on which the fastening arm (25) is mounted to pivot between a flight position and a fastening position, in which the fastening rod (27A, 27B, 27C) is disposed vertically.

12. The traction system as claimed in claim 1, wherein the fastening rod (27A, 27B, 27C) has a tube through which the folding line (10A, 10B, 10C) passes, an end of the folding line (10A, 10B, 10C) is connected to the fastening arm (25).

13. The traction system as claimed in claim 1, further comprising a mooring carriage (12B) designed to slide along the mooring mast (4), the mooring carriage (12B) having an interlocking interface (35) for the capturing device (22).

14. The traction system as claimed in claim 13, wherein the mooring carriage (12B) has an immobilizing device to immobilize the capturing device (22) against the interlocking interface (35).

15. The traction system as claimed in claim 14, wherein the immobilizing device has an immobilizing hook (48, 49) which is movable between a retracted position and an immobilizing position, in which the immobilizing hook (48, 49) locks the fastening arm (25) against the interlocking interface (35).

16. The traction system as claimed in claim 1, wherein:

the folding lines (10A, 10B, 10C) are arranged in pairs, the folding lines of a pair connecting the capturing device (22) to points on the leading edge (16) that are symmetrically on either side of the capturing device (22);

the capturing device has two fastening arms (25) each provided with as many fastening rods (27A, 27B, 27C) as there are pairs of folding lines (10A, 10B, 10C).

17. The traction system as claimed in claim 16, wherein the fastening rods (27A, 27B, 27C) are disposed in stepped fashion.

18. The traction system as claimed in claim 16, further including as many folding carriages (12C, 12D, 12E) as pairs of folding lines (10A, 10B, 10C), each folding carriage (10A, 10B, 10C) having a pair of capturing hooks (46A, 46B, 46C) which are movable between a retracted position and a capturing position, in which the capturing hooks (46A, 46B, 46C) of a pair surround the fastening rods (27A, 27B, 27C) of the two fastening arms (25).

19. The traction system as claimed in claim 1, wherein:

the traction wing (5) has a furling line (13) designed to furl the traction wing (5);

the capturing device (22) has a furling rod (42), the furling line (13) projecting in the continuation of the furling rod (42);

the traction system has a furling carriage (12A) designed to slide along the mooring mast (4), the furling carriage (12A) having a furling hook (47) which is movable between a retracted position and a capturing position, in which the furling hook (47) surrounds the furling rod (42).

20. The traction system as claimed in claim 1, wherein the capturing hook (46A, 46B, 46C) is controlled by a mechanism actuated by another carriage designed to slide along the mooring mast (4).

21. A process for deploying or folding the traction wing of a traction system as claimed in claim 1, the process comprising the step of:

immobilizing the capturing device (22) in relation to the folding carriage (12C, 12D, 12E) in a position in which the fastening rod (27A, 27B, 27C) faces the capturing hook (46A, 46B, 46C).

* * * * *